US006943488B2

(12) United States Patent
Yasui et al.

(10) Patent No.: US 6,943,488 B2
(45) Date of Patent: Sep. 13, 2005

(54) STRUCTURES, ELECTRON-EMITTING DEVICES, IMAGE-FORMING APPARATUS, AND METHODS OF PRODUCING THEM

(75) Inventors: Nobuhiro Yasui, Kanagawa (JP); Tohru Den, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 09/953,271

(22) Filed: Sep. 17, 2001

(65) Prior Publication Data

US 2002/0121851 A1 Sep. 5, 2002

(30) Foreign Application Priority Data

Sep. 20, 2000 (JP) ..... 2000-285949
Apr. 24, 2001 (JP) ..... 2001-126400
Sep. 3, 2001 (JP) ..... 2001-266062

(51) Int. Cl.[7] ..... H01J 1/46; H01J 21/10

(52) U.S. Cl. ..... 313/301; 313/310; 313/309; 313/351; 313/336; 313/346 R

(58) Field of Search ..... 313/301, 310, 313/309, 351, 336, 495, 346 R

(56) References Cited

U.S. PATENT DOCUMENTS 6,204,596 B1 * 3/2001 Macaulay et al. ..... 313/310
6,278,231 B1 8/2001 Iwasaki et al. ..... 313/310
6,476,409 B2 * 11/2002 Iwasaki et al. ..... 257/13
6,498,426 B1 * 12/2002 Watabe et al. ..... 313/310
6,525,461 B1 * 2/2003 Iwasaki et al. ..... 313/495

FOREIGN PATENT DOCUMENTS

| | | |
|---|---|---|
| EP | 0 913 508 A2 | 5/1999 |
| EP | 0 951 047 A2 | 10/1999 |
| JP | 5-211030 | 8/1993 |
| JP | 10-12124 | 1/1998 |
| JP | 11-194134 | 7/1999 |
| JP | 11-200090 | 7/1999 |
| JP | 2000-031462 | 1/2000 |

* cited by examiner

*Primary Examiner*—Joseph Williams
*Assistant Examiner*—Kevin Quarterman
(74) *Attorney, Agent, or Firm*—Fitzpatrick, Cella, Harper & Scinto

(57) ABSTRACT

Provided are electron-emitting devices improved in durability during concentration of an electric field and thus rarely suffering chain discharge breakdown. An electron-emitting device has an electroconductive film, a layer placed on the electroconductive film and containing aluminum oxide as a main component, a pore placed in the layer containing aluminum oxide as a main component, and an electron emitter placed in the pore and containing a material of the electroconductive film, and the electron emitter is porous and is electrically connected to the electroconductive film.

33 Claims, 13 Drawing Sheets

1ST ANODIZATION

2ND ANODIZATION

THERMAL
REDUCTION PROCESS

HOLE WIDTH
ENLARGING PROCESS

THERMAL REDUCTION PROCESS

HOLE WIDTH ENLARGING PROCESS

FORM DERIVING ELECTRODE

AFTER 1ST AND 2ND ANODIZATIONS

AFTER THERMAL PROCESSING

REGULATED NANO-HOLE

NORMAL NANO-HOLE

FIG.9

UPPER UNDERLYING ELECTRODE

| | COMPARATIVE EXAMPLE | Nb | Mo | Ta | Ti | Zr | Hf |
|---|---|---|---|---|---|---|---|
| 5/6 | GOOD | GOOD | GOOD | GOOD | GOOD | GOOD | GOOD |
| 1/2 | PARTIALLY DESTROYED | GOOD | GOOD | GOOD | GOOD | GOOD | GOOD |
| 1/6 | DESTROYED | GOOD | GOOD | GOOD | GOOD | GOOD | GOOD |
| 1/12 | DESTROYED | GOOD | GOOD | GOOD | GOOD | GOOD | GOOD |

FIG.10

| Nb FILM THICKNESS(nm) | NON | 1nm | 5nm | 10nm | 20nm |
|---|---|---|---|---|---|
| HEIGHT OF ENCLOSED SUBSTANCE(nm) | 230nm | 235nm | 253nm | 268nm | 280nm |

FIG.11

| Nb FILM THICKNESS(nm) | NON | 1nm | 5nm | 10nm | 20nm |
|---|---|---|---|---|---|
| ELECTRON EMISSION RATIO | 1.0 | 0.97 | 0.86 | 0.45 | UNMEASURABLE |

STRUCTURES, ELECTRON-EMITTING DEVICES, IMAGE-FORMING APPARATUS, AND METHODS OF PRODUCING THEM

BACKGROUND OF THE INVENTION

1. Field of the Invention

The present invention relates to structures, structures to which anodized alumina nano-holes are applied, production methods thereof, electron-emitting devices, and image-forming apparatus. Particularly, the structures of the present invention can be applied to electron-emitting devices, image-forming apparatus, electrochromic devices, imaging tubes, and so on.

2. Related Background Art

Considerable research is now under way on the electron-emitting devices having the properties of uniformity, fineness, high efficiency, and long life, as typified by flat panel displays. For forming microscopic electron-emitting regions of the devices, a lot of processes are performed by making use of the semiconductor processing techniques including photolithography, electron beam exposure, and so on.

However, application of materials having microscopic structure (nano-structures) can be listed as a simple method of forming the electron-emitting regions uniformly and in a large area. Particularly, attention is being drawn to structures formed in a self-organizing manner.

For the nano-structures, it is preferable to employ a porous film of alumina obtained by anodization of aluminum. First, the anodization of aluminum has such features that, when it is done in an aqueous solution of oxalic acid, phosphoric acid, or sulfuric acid, pores (nano-holes) are formed in nano-size so as to be surrounded by a barrier layer (alumina), thereby yielding a porous film; and that, when it is done in an aqueous solution of ammonium borate, ammonium tartrate, or ammonium citrate, the pores are not formed but a uniform alumina film (barrier film) is formed, thereby yielding a barrier film.

FIGS. 2A, 2B, and 2C are schematic views of films obtained by the anodization of aluminum, wherein FIG. 2A is a plan view of the porous film, FIG. 2B a cross-sectional view along line 2B—2B of FIG. 2A, and FIG. 2C a cross-sectional view of the barrier film. The porous film of alumina is characterized by having such a specific geometrical structure that extremely fine, cylindrical pores 21 having pore diameters 26 of several nm to several hundred nm are arrayed in parallel at spacing 25 of several ten nm to several hundred nm, as shown in FIGS. 2A and 2B. Then the array spacing of pores can be controlled by adjusting an electric current and a voltage during the anodization.

Concerning this porous film of alumina, there are such attempts that an electron-emitting member is placed inside each of the holes to form an electron-emitting region and one electron-emitting device is constructed of an assembly of plural electron-emitting regions (e.g., Japanese Patent Applications Laid-Open No. 05-211030, Laid-Open No. 10-12124, and so on). This structure is characterized in that the sizes of the holes are very small. This makes use of the advantages that the electron-emitting regions have a small radius of curvature at the tip, so as to facilitate concentration of an electric field, and thus electron emission occurs readily and that the electric current is stable, because one electron-emitting device is constructed of a plurality of electron-emitting regions.

There are, however, demands for decreasing dispersion among the individual electron-emitting regions and distribution of the electric field and for making the production process simpler.

SUMMARY OF THE INVENTION

For readily forming the electron-emitting devices having the even electron-emitting regions in a large area, it is useful to use the foregoing porous alumina film. In the conventional devices, however, uniformity of the electron-emitting regions was insufficient and unevenness of the field concentration resulting therefrom could lead to decrease in lifetimes of the electron-emitting regions.

For solving it, it is desirable to improve the uniformity of the electron-emitting regions and improve durability against local field concentration. It is also necessary to simplify the production process.

The present invention has been accomplished in order to solve the problems of the prior arts as described above, and an object of the invention is to provide structures with improved durability during the field concentration and with sufficient resistance to chain discharge breakdown and easy production methods of such structures, and also to provide structures with high uniformity, and electron-emitting devices and image-forming apparatus.

The above object can be achieved by the following configurations and production methods according to the present invention.

An aspect of the present invention is a structure comprising an electroconductive film, a layer placed on the electroconductive film and comprising aluminum oxide as a main component, a pore placed in the layer comprising aluminum oxide as a main component, and an electric conductor placed in the pore and comprising a material of the electroconductive film, wherein the electric conductor is porous and is electrically connected to the electroconductive film.

Another aspect of the present invention is an electron-emitting device comprising an electroconductive film, a layer placed on the electroconductive film and comprising aluminum oxide as a main component, a pore placed in the layer comprising aluminum oxide as a main component, and an electron emitter placed in the pore and comprising a material of the electroconductive film, wherein the electron emitter is porous and is electrically connected to the electroconductive film.

Another aspect of the present invention is a structure in which an enclosed substance is formed from a bottom portion of a pore formed by anodization of a film laid on an underlying electrode and comprising aluminum as a main component, wherein the enclosed substance comprises a constitutive element of the underlying electrode or an oxide thereof as a main component and is porous.

Another aspect of the present invention is a method of producing a structure in which an enclosed substance is formed from a bottom portion of a pore formed by anodization of a film laid on an underlying electrode and comprising aluminum as a main component, the method comprising a step of carrying out anodization by use of a bath for forming a porous film, for the film comprising aluminum as a main component, a step of carrying out anodization by use of a bath for forming a barrier film, and a step of carrying out a thermal treatment.

Another aspect of the present invention is a structure comprising:

an electroconductive film;

a layer placed on the electroconductive film and comprising aluminum oxide as a component;

a pore placed in the layer comprising aluminum oxide as a component; and a porous electric conductor placed in the pore, electrically connected to the electroconductive film, and comprising a material of the electroconductive film, wherein the electroconductive film consists of two or more layers of films and at least one element out of elements included in every film is different from at least one element out of elements included in the other films.

Another aspect of the present invention is an electron-emitting device comprising:

an electroconductive film;

a layer placed on the electroconductive film and comprising aluminum oxide as a component;

a pore placed in the layer comprising aluminum oxide as a component; and a porous electron emitter placed in the pore, electrically connected to the electroconductive film, and comprising a material of the electroconductive film, wherein the electroconductive film consists of two or more layers of films and at least one element out of elements included in every film is different from at least one element out of elements included in the other films.

Another aspect of the present invention is a structure in which a porous enclosed substance comprising a constitutive element of an underlying electrode or an oxide thereof as a component is formed from a bottom portion of a pore formed by anodization of a film laid on the underlying electrode and comprising aluminum as a component, wherein the underlying electrode consists of two or more layers of films and at least one element out of elements included in every film is different from at least one element out of elements included in the other films.

Another aspect of the present invention is a method of producing a structure in which a porous enclosed substance comprising a constitutive element of an underlying electrode or an oxide thereof as a component is formed from a bottom portion of a pore formed by anodization of a film laid on the underlying electrode and comprising aluminum as a component, wherein the underlying electrode consists of two or more layers of films and at least one element out of elements included in every film is different from at least one element out of elements included in the other films.

According to the structure of the present invention, the enclosed substance is electrically conductive and thus is applicable to the electron-emitting region. When the structure of the present invention is used as an electron-emitting device, even if the electric field is concentrated unevenly on the enclosed substance as an electron-emitting region to cause microdischarge, it will act as a current limiting resistance because of the porous structure, thereby making it feasible to provide the nano-structure resistant to discharge.

When the pores (nano-holes) are regularly arrayed, the uniformity of shapes of the nano-holes is considerably improved and the electric field is also applied evenly as compared with irregular arrays, which makes it feasible to stabilize electric current values based on emission of electrons. Further, sizes of portions without the enclosed substance in the nano-holes are larger than those of portions with the enclosed substance, whereby the electric field becomes easier to concentrate and whereby electrons become easier to emerge from the nano-holes.

According to the above features, the electron-emitting regions are protected from discharge, which can lengthen the lifetimes thereof.

When a deriving electrode is formed at the upper part of the nano-hole in the structure of the present invention, electrons can be emitted efficiently. Here the distance between the deriving electrode and the electron-emitting region can be controlled with high accuracy by an anodization voltage during formation of the electron-emitting region.

Further, the production method of the structure according to the present invention enables the enclosed substances serving as electron-emitting regions of uniform height to be formed readily and in a large area.

BRIEF DESCRIPTION OF THE DRAWINGS

FIG. 9 is a table showing the results of visual observation after execution of the second anodization in 0.05 mol/l ammonium borate aqueous solution and at the applied voltage of 160 V in the sixth example of the structure according to the present invention;

FIG. 10 is a table showing the results of observation to observe the heights of enclosed substances after formation of the enclosed substances by execution of the second anodization in 0.05 mol/l ammonium borate aqueous solution and at the applied voltage of 160 V in the seventh example of the structure according to the present invention;

FIG. 11 is a table showing the results of measurement of electron emission ratio in the seventh example of the structure according to the present invention;

DETAILED DESCRIPTION OF THE PREFERRED EMBODIMENTS

The first structure of the present invention will be described below on the basis of the drawings.

Figure 1A:
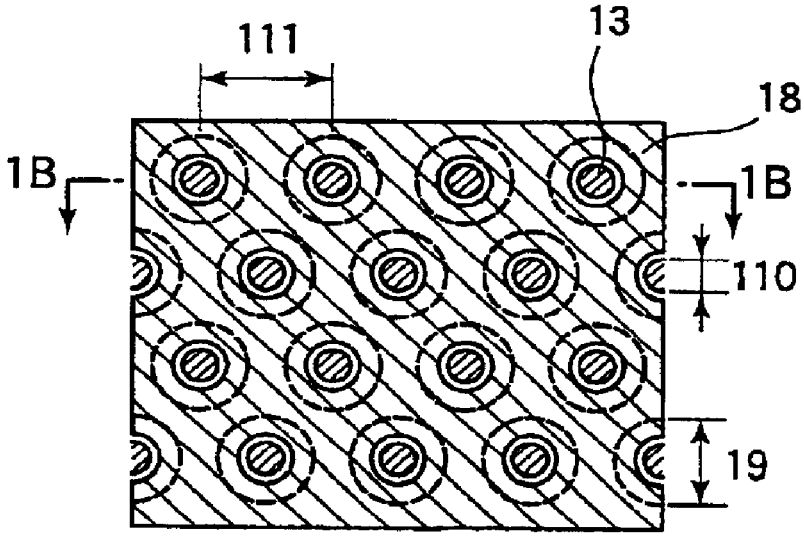
FIGS. 1A and 1B are schematic views showing an embodiment of the structure according to the present invention.
Figure 1B:
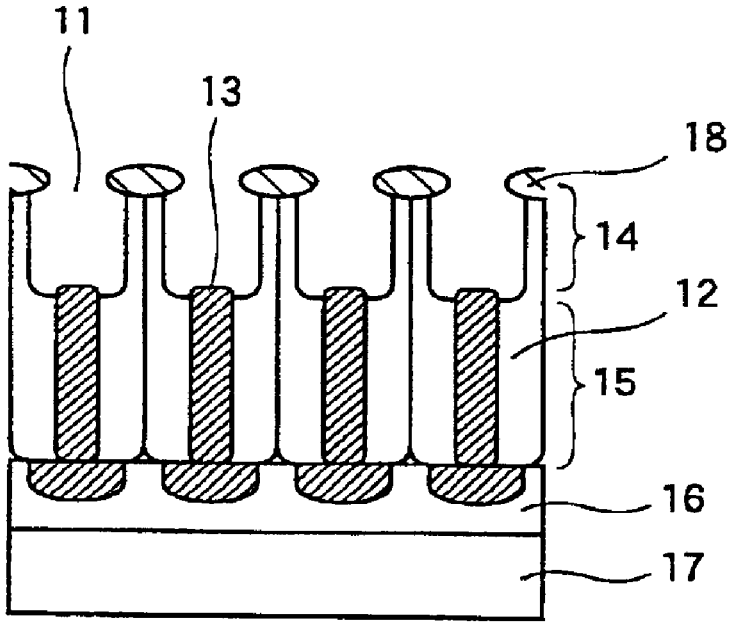
Figure 2A:
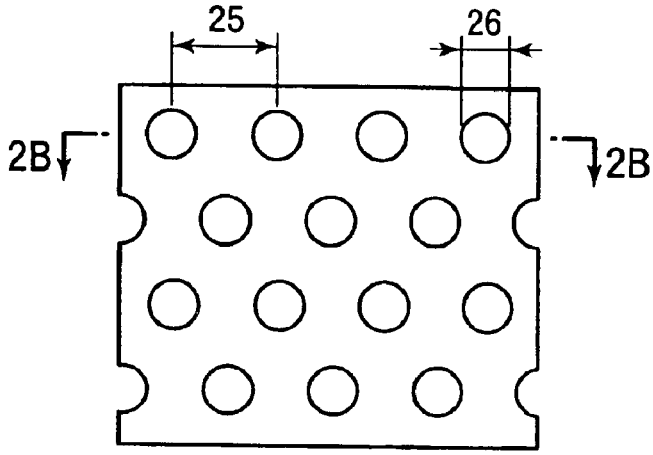
FIGS. 2A, 2B, and 2C are schematic views of anodized alumina nano-holes.
Figure 2B:
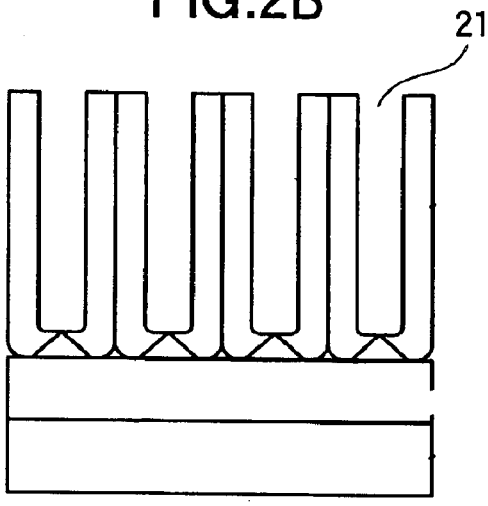
Figure 2C:
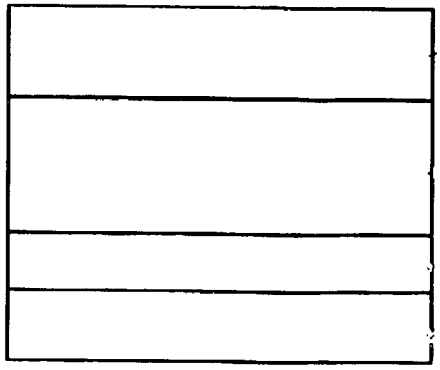

FIGS. 1A and 1B are schematic views showing an embodiment of the first structure of the present invention, wherein FIG. 1A is a plan view and FIG. 1B a cross-sectional view along line 1B—1B of FIG. 1A. In FIGS. 1A and 1B, numeral 11 designates pores of nano-size (nano-holes) and 12 a barrier layer (alumina). Numeral 13 denotes enclosed substances (electron-emitting members) of an electric conductor, which have a porous shape, as shown in the cross-sectional shape of FIG. 5B. Numeral 14 represents a portion without the enclosed substances, 15 a portion with the enclosed substances, 16 an underlying electrode of an electroconductive film, 17 a substrate, 18 a deriving electrode, 19 an upper pore size (of the portion without the enclosed substances), 110 a lower pore size (of the portion with the enclosed substances), and 111 a spacing of the pores (nano-holes). In the present invention the "electric conductor" making the enclosed substances embraces metals and semiconductors. The "electric conductor" making the enclosed substances can also be referred to as a material having the band gap of not more than 4 eV and, preferably, not more than 3.5 eV.

The pores (nano-holes) in the structure of nano-size (also called "nano-structure") can be formed by use of a bath capable of forming a porous film by anodization of aluminum, e.g., by use of oxalic acid, phosphoric acid, sulfuric acid, or the like. Alumina portions surrounding the pores (nano-holes) at this time are the barrier layer (alumina) 12.

Then the porous enclosed substances (electron-emitting members) 13 can be made by use of a bath capable of forming a barrier film of uniform alumina film by the anodization of aluminum, e.g., by use of ammonium borate, ammonium tartrate, ammonium citrate, or the like.

The enclosed substances (electron-emitting members) 13 are porous and are made of a material a main component of which is a constitutive element of the underlying electrode 16 of the electroconductive film or a material a main component of which is an oxide of the constitutive element. When the structure of the present invention is used as an electron-emitting device, it is preferable to carry out a reduction process described hereinafter to improve the electric conductivity of the enclosed substances 13, because the enclosed substances 13 immediately after the formation according to the above method are often of oxide form.

The height of the enclosed substances (electron-emitting members) 13 can be controlled by the applied voltage during the anodization in the bath for forming the barrier film. The voltage can be applied stepwise or directly up to a desired voltage to form the enclosed substances at an equivalent height.

The barrier layer (alumina) 12 in the present invention represents the alumina portions separating the pores from each other in the porous film, and the barrier film does a uniform film of alumina obtained when the conventional anodization of aluminum is carried out in the bath of ammonium borate or the like, and is used in comparison with the porous film. Accordingly, when the anodization is carried out using the bath for forming the porous film in the present invention, a porous film is obtained. However, when the anodization of the porous film is subsequently carried out using the bath for forming the barrier film, the cylindrical enclosed substances are formed in the pores without forming the barrier film, which is the feature.

The spacing 111 of the pores (nano-holes) can be controlled by the applied voltage during the anodization in the bath for formation of the porous film. The spacing 111 of the pores (nano-holes) to be formed can be controlled to a desired value by regularly forming pore-forming start points in a surface of aluminum before the anodization by FIB (Focused Ion Beam), a mold with regular projections, the lithography technology with light or an electron beam, or the like.

The size 110 of the lower nano-holes (the portion with the enclosed substances) can be controlled by a time of a hole width enlarging process after the anodization in the bath for formation of the porous film.

The size 19 of the upper nano-holes (the portion without the enclosed substances) can be controlled by a time of a hole width enlarging process after the anodization in the bath for formation of the barrier film, or after the thermal treatment.

The latter hole width enlarging process can be carried out by dipping in phosphoric acid. The size can be controlled by the time.

The substrate 17 in FIGS. 1A, 1B can be any material on which the underlying electrode 16 and the film the main component of which is aluminum can be formed. For example, the substrate can be either of materials flat and resistant to the temperatures of about 400° C.; for example, glasses, oxides such as $SiO_2$, $Al_2O_3$, etc., semiconductors such as Si, GaAs, InP, and so on. The underlying electrode 16 can be either material selected from metals such as W, Nb, Mo, Ta, Ti, Zr, Hf, and so on.

When the deriving electrode 18 in FIGS. 1A, 1B is formed so as to overlap like a cap at the upper end of each nano-hole, electrons can be emitted efficiently.

A further preferred structure of the second form according to the present invention will be illustratively described below in detail with reference to the drawings. The structure of the second form described hereinafter is more suitable for the formation of the foregoing enclosed substances 13 in a good yield than the structure of the first form described above with reference to FIGS. 1A, 1B and others.

It is, however, noted that the dimensions, materials, shapes, relative locations, etc. of the components used in the second form described hereinafter are by no means intended to limit the scope of the invention only to them unless otherwise stated in particular.

Further, in the drawings described hereinafter, the same reference numerals will also denote members similar to those described with the drawings heretofore.

The forms and examples of the second structure described hereinafter will also explain embodiments and examples of the electron-emitting devices, image-forming apparatus, nano-structures, and production methods thereof according to the present invention.

Figure 7A:
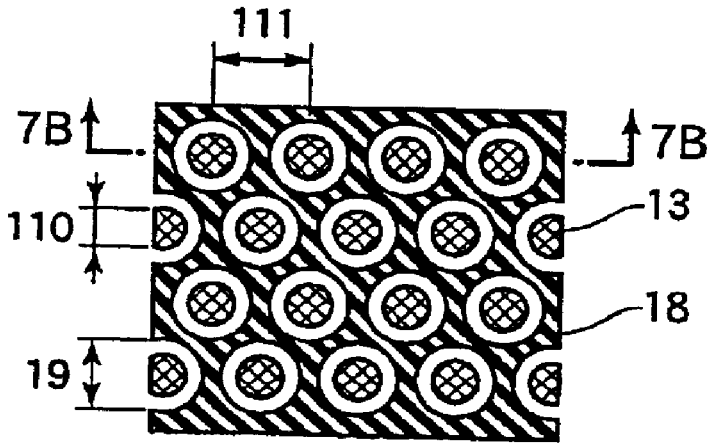
FIGS. 7A and 7B are schematic views showing another embodiment of the structure according to the present invention.
Figure 7B:
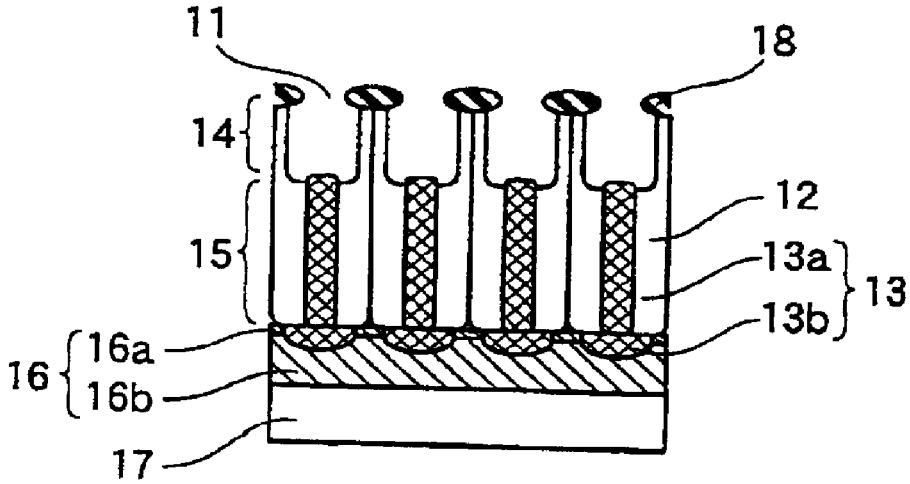

FIGS. 7A and 7B are schematic views of an embodiment of the structure of the second form according to the present invention, wherein FIG. 7A is a plan view and FIG. 7B a cross-sectional view along line 7B—7B of FIG. 7A.

In FIGS. 7A and 7B, reference numeral 11 designates the nano-holes (pores) and 12 the barrier layer (alumina) as a layer containing aluminum oxide as a component. Numeral 13 denotes the enclosed substances (electron-emitting members) consisting of a porous electric conductor. Numeral 13*a* represents upper enclosed substances, 13*b* underlying-electrode-occupying enclosed substances, 14 the portion without the upper enclosed substances, 15 the portion with the enclosed substances, 16 the underlying electrode (electrode) consisting of an electroconductive film, 16*a* an upper underlying electrode (first electrode), 16*b* a lower underlying electrode (second electrode), 17 the substrate, 18 the deriving electrode, 19 the size of the upper nano-holes (the portion without the enclosed substances), 110 the size of the lower nano-holes (the portion with the enclosed substances), and 111 the spacing of the pores (nano-holes).

However, the barrier layer 12 is not limited only to the layer containing aluminum oxide as a component, but it may also be a layer containing aluminum oxide as a main component.

The pores 11 can be formed by use of a bath (oxalic acid, phosphoric acid, sulfuric acid, etc.) commonly known as those for formation of porous film in anodization of aluminum.

The alumina portions surrounding the nano-holes at this time constitute the barrier layer (alumina) 12.

The porous enclosed substances (electron-emitting regions) 13*a* and the underlying-electrode-occupying enclosed substances (electron-emitting regions) 13*b* can be formed by use of the bath (ammonium borate, ammonium tartrate, ammonium citrate, etc.) capable of forming the barrier film being a uniform alumina film in the anodization of aluminum, as in the case of the enclosed substances of the first structure described previously.

When the second structure of the present invention is used as an electron-emitting device, it is also preferable to carry out the process of enhancing the electric conductivity of the enclosed substances 13 by the reduction process, because the enclosed substances 13 immediately after the formation according to the above method are often of oxide form.

In the second structure of the present invention, the "electric conductor" making the enclosed substances also embraces metals and semiconductors. The "electric conductor" making the enclosed substances can also be referred to as a material having the band gap of not more than 4 eV and, preferably, not more than 3.5 eV.

During the production of the aforementioned first structure of the present invention, where the structure had the underlying electrode of only the W layer, electric current values during the anodization were observed in the step using the bath (oxalic acid, phosphoric acid, sulfuric acid, etc.) for the formation of the porous film in the anodization, and it was found from the observation that unless the anodization was ended at the current value equal to 5/6 of the constant current value, the yield was poor in the next step of forming the enclosed substances.

However, when the structure is constructed like the second structure of the present invention wherein the upper underlying electrode 16*a* is a film containing at least one element out of Nb, Mo, Ta, Ti, Zr, and Hf as a main component and the lower underlying electrode 16*b* is a film containing W as a main component, the end condition can be expanded to the range of 5/6 to 1/12 of the constant current value.

However, the second structure of the present invention is not limited to the configuration wherein the upper underlying electrode (first electrode) 16*a* is the film containing at least one element of Nb, Mo, Ta, Ti, Zr, and Hf as a main component and the lower underlying electrode (second electrode) 16*b* is the film containing W as a main component, but it can also be of a configuration wherein the upper underlying electrode (first electrode) 16*a* is a film containing at least one element of Nb, Mo, Ta, Ti, Zr, and Hf as a component and the lower underlying electrode (second electrode) 16*b* is a film containing W as a component.

In the second structure of the present invention, part of the upper underlying electrode 16*a* is occupied by the lower enclosed substances 13*b*. The upper underlying electrode 16*a* is characterized in that it exists in the portions except for immediately below the pores 11, or in the portions immediately below the junctions of the barrier layer 12.

The underlying-electrode-occupying enclosed substances 13*b* are produced during the process of forming the second structure of the present invention.

The height of the enclosed substances (electron-emitting members) 13*a* is proportional to the voltage applied in the step using the bath (ammonium borate, ammonium tartrate, ammonium citrate, etc.) known as one for the formation of barrier film. The height also varies depending upon the material of the underlying electrode 16. The height of the enclosed substances can be made equal by applying the voltage stepwise or directly up to a desired voltage.

The spacing 111 of the pores can be controlled by the applied voltage during the anodization in the bath for the formation of the porous film, as described previously. When start points are regularly formed before the anodization by making use of the FIB (Focused Ion Beam), the mold with regular projections, the lithography technology with light or an electron beam, or the like, the spacing 111 of the nano-holes can be made constant regardless of locations.

The size 110 of the lower nano-holes (the portion with the enclosed substances) can be controlled by the time of the hole width enlarging process after the anodization in the bath for the formation of porous film. The size 19 of the upper nano-holes (the portion without the enclosed substances) can be controlled by the time of the hole width enlarging process after the anodization in the bath for the formation of the barrier film, or after the thermal treatment.

The substrate 17 can be any material on which the underlying electrode 16 and the film containing Al as a main component can be formed.

For example, the substrate can be one selected, e.g., from the oxides such as $SiO_2$, $Al_2O_3$, etc., and the semiconductors such as Si, GaAs, InP, etc. and being flat and resistant to the temperatures of about 400° C. The underlying electrode can be one selected from the metals such as W, Nb, Mo, Ta, Ti, Zr, Hf, and so on.

The substrate 17 and the underlying electrode 16 can be made in an integral form, and the substrate 17 can be a metal sheet of W, Nb, Mo, Ta, Ti, Zr, Hf, or the like. When the substrate 17 is a metal sheet of W, Nb, Mo, Ta, Ti, Zr, Hf, or the like, the underlying electrode 16 consisting of two or more layers means that the substrate 17 is regarded as a single layer, and it is also feasible to achieve the effects of the present invention under such circumstances When the deriving electrode 18 in FIGS. 7A, 7B is formed so as to overlap like a cap at the upper end of each nano-hole, electrons can be emitted efficiently.

When the enclosed substances 13 of the above structure are used as electron-emitting members, the foregoing structure functions as an electron-emitting device.

When this electron-emitting device is combined with a member equipped with an image-forming member, e.g., like a fluorescent member, to be irradiated with electrons emitted from the electron-emitting device, an image-forming apparatus according to the present invention is constructed.

EXAMPLES

The present invention will be described below in further detail with examples thereof. In the following description, the anodization in the bath for the formation of the porous film will be called first anodization, and the anodization in the bath for the formation of the barrier film, second anodization.

Example 1

The present example presents procedures of producing the structure of the present invention.

The structure was produced according to the following procedures shown in FIGS. 3A to 4G.

1) Layered films consisting of a film of tungsten 32 (50 nm thick) and a film of aluminum 31 (500 nm thick) were deposited on a glass substrate 33 by RF sputtering. Further, indentations were formed as pore-forming start points in a honeycomb pattern at intervals of 100 nm on the surface of aluminum by FIB (Focused Ion Beam). (cf. FIG. 3A)

2) The first anodization was carried out by dipping the film of aluminum 31 in 0.3M oxalic acid aqueous solution at 16° C. and applying the voltage of 40 V thereto. (cf. FIG. 3B)

3) Subsequently, the second anodization was carried out by applying the voltage of 200 V in 0.05M ammonium borate aqueous solution at 10° C. (cf. FIG. 4C)

4) The hole width enlarging process may be conducted in the above state, or the thermal reduction process may also be carried out first. The thermal reduction process reduces the enclosed substances (tungsten oxide) 35 into porous tungsten 36. (cf. FIGS. 4D and 4E).

5) When the hole width enlarging process was carried out in the above step, the thermal reduction process is carried out herein; or, when the thermal reduction treatment was carried out in the above step, the hole width enlarging process is carried out herein. (cf. FIG. 4F)

6) In the final step, a film of tantalum becoming the deriving electrode 37 is formed by oblique incidence sputtering. (cf. FIG. 4G)

Cross sections of samples produced according to the above two ways of production procedures were observed according to the procedures with FE-SEM.

Figure 3A:
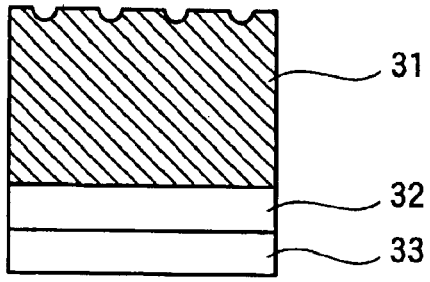
FIGS. 3A and 3B are schematic views showing states at respective fabrication stages of the structure according to the present invention.
Figure 3B:
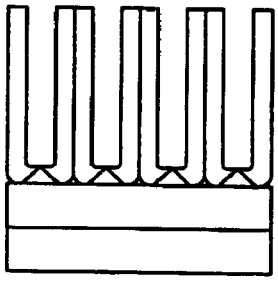
Figure 4C:
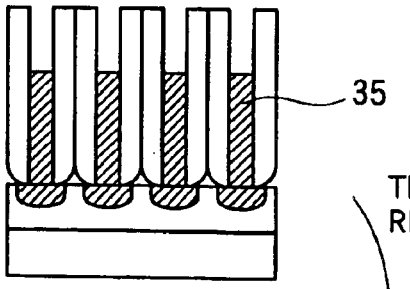
FIGS. 4C, 4D, 4E, 4F, and 4G are schematic views showing states at respective fabrication stages of the structure according to the present invention.
Figure 4D:
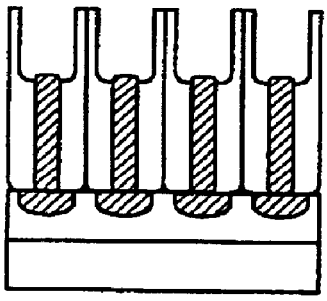
Figure 4E:
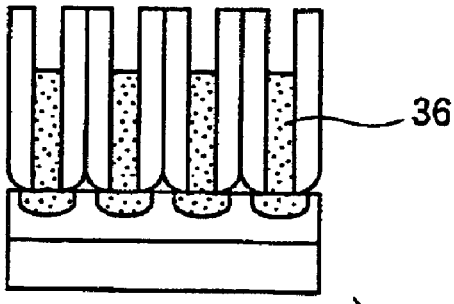
Figure 4F:
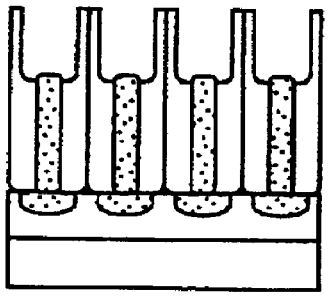
Figure 4G:
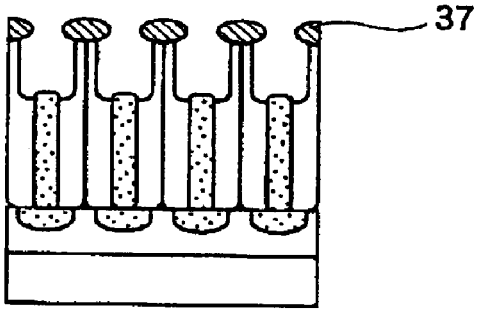

It was verified from the observation that, in each of the procedures, the structure corresponding to FIG. 3A was formed after the procedure 1), the structure corresponding to FIG. 3B after the procedure 2), the structure corresponding to FIG. 4C after the procedure 3), the structures corresponding to FIG. 4D and FIG. 4E after the respective procedures 4), the structure corresponding to FIG. 4F after the procedure 5), and the structure corresponding to FIG. 4G after the procedure 6).

Example 2

The present example concerns the enclosed substances of the nano-structure.

W, Si, Nb, Pt, Mo, Ta, Ti, Zr, and Hf films were deposited in the thickness of 50 nm on respective substrates by RF sputtering, thereby preparing nine types of substrates. After that, an aluminum film was further deposited in the thickness of 500 nm on each of the substrates. Then each of the substrates was subjected to the first anodization and the second anodization in the same manner as in Example 1. After that, they were observed with FE-SEM. For the sample with the tungsten film, the state of the enclosed substances subjected to the thermal reduction process was also observed with FE-SEM.

It was verified from the observation that among the W, Si, Nb, Pt, Mo, Ta, Ti, Zr, and Hf films, the enclosed substances were formed only in the samples using the W, Nb, Mo, Ta, Ti, Zr, and Hf films, but the enclosed substances were not formed in the other samples of Si and Pt.

Figure 5A:
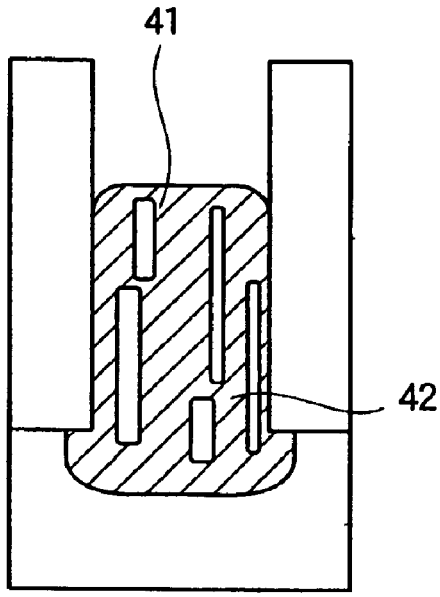
FIGS. 5A and 5B are views showing states of the enclosed substance in the structure of the present invention.
Figure 5B:
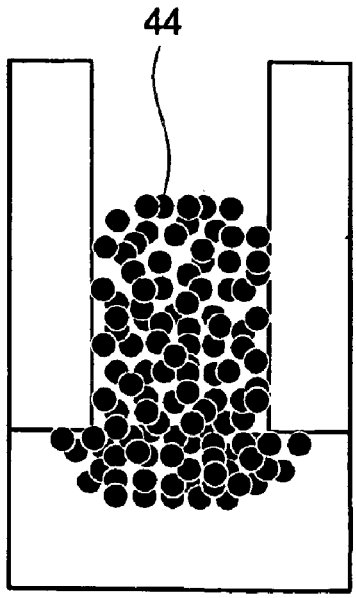

Among the samples in which the enclosed substances were formed, the sample using tungsten was observed in detail, and it became clear therefrom that there existed voids of bubbles 42 in the enclosed substances (tungsten oxide) 41 before the thermal reduction process, as shown in FIG. 5A. It was also confirmed that the state after the thermal reduction process was that the enclosed substances were reduced into a binding state of particulate substances (porous tungsten), as shown in FIG. 5B.

The packing factor after the formation of the enclosed substances 41 was approximately 78%, and the pacing factor of the enclosed substances 44 after the thermal reduction process was approximately 67%.

Example 3

The present example concerns the applied voltage during the second anodization in the production of the structure and fluctuations of the height of the enclosed substances depending thereupon.

The first anodization step was carried out under the same conditions as in Example 1.

First prepared were four samples which were through the first anodization step as in Example 1. The second anodization step was also carried out under the conditions of the bath as in Example 1.

In the second anodization step, voltages applied to the respective samples were 100 V, 130 V, 160 V, and 200 V, respectively.

Evaluation

After completion of the anodization, cross sections of the samples were observed with FE-SEM to estimate heights of the enclosed substances and rough fluctuation levels. The results are presented in Table 1 below.

TABLE 1

| Applied of Voltage (V) | Height of enclosed substance | Fluctuation of height enclosed substance (nm) |
|---|---|---|
| 100 | 115 | ±10 nm or less |
| 130 | 175 | ±5 nm or less |
| 160 | 231 | ±10 nm or less |
| 200 | 300 | ±5 nm or less |

It was found from Table 1 above that the relation between height of enclosed substances and applied voltage was a proportional relation and was generally given by the following equation.

$$\text{Height of enclosed substances (nm)}=[1.8\times\text{applied voltage (V)}]-60$$

Fluctuation amounts of the height of the enclosed substances were roughly estimated by observing about hundred enclosed substances and maximum fluctuations were obtained as in the above table, which confirmed that the fluctuations were small.

Example 4

The present example concerns regularization of the nano-holes.

The tungsten film (50 nm thick) and aluminum film (500 nm thick) were deposited on a glass substrate by RF sputtering and indentations were formed in the honeycomb pattern therein by FIB (Focused Ion Beam). The spacing of the indentations was 100 nm.

Then the first anodization was carried out by applying the voltage of 40 V in 0.3M oxalic acid aqueous solution, and the second anodization by applying the voltage of 200 V in 0.05M ammonium borate aqueous solution.

Figure 6A:
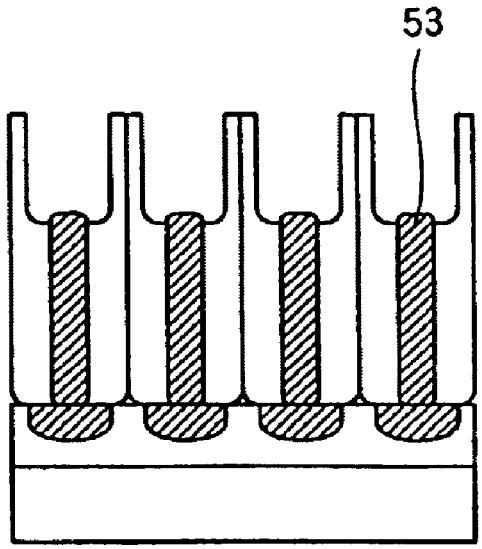
FIGS. 6A and 6B are schematic views showing regulated nano-holes according to the present invention.
Figure 6B:
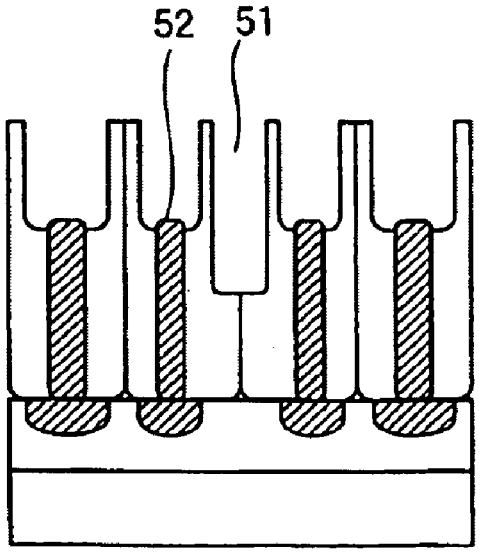

Cross sections of this sample were observed with FE-SEM. For comparison, a sample prepared without FIB was also observed. It was verified from the observation that, with the sample produced through the regularization, the normal nano-holes (enclosed substances) 53 were completely normal to the underlying electrode and all were straight, as shown in FIG. 6A. In contrast with it, with the sample produced without the regularization, the nano-holes were approximately normal to the underlying electrode but there were nano-holes 51 failing to reach the underlying electrode and enclosed substances 52 of small sizes, as shown in FIG. 6B. This affects the surrounding nano-holes, so as to cause dispersion of sizes of nano-holes. As a consequence, the electric field was concentrated more there than at the other enclosed substances, so that electric current values became unstable.

It was, therefore, confirmed that the nano-holes thus regularized had high uniformity and were important to stabilization of electric current values.

Example 5

The present example concerns the durability of the electron-emitting device using the structure.

Samples were prepared as follows. By the method similar to that in Example 1, the tungsten film (50 nm thick) and aluminum film (500 nm thick) were deposited on a glass substrate by RF sputtering, and the first anodization and the second anodization were carried out by the voltage of 40 V and by the voltage of 200 V, respectively. After that, one sample was not subjected to the hole width enlarging process, but another sample was subjected to the hole width enlarging process in phosphoric acid 5 wt % for 50 minutes.

In the subsequent step, the thermal treatment was carried out at 400° C. in a hydrogen atmosphere (which can be either a carbon monoxide atmosphere or a vacuum) for two hours.

In the final step the deriving electrode of tantalum was formed by oblique incidence sputtering (cf. FIG. 1B). The distance between the deriving electrode and the electron-emitting regions was approximately 300 nm. The size of the electron-emitting regions at this time was 45 nm. The size of the portion without the electron-emitting regions in the upper part of the pores (nano-holes) was 45 nm or 77 nm, depending upon whether or not the hole width enlarging process was carried out.

On the other hand, a sample for comparison was also prepared by burying nickel in the pores of the structure obtained through the hole width enlarging process in the same manner as the above sample, by electrodeposition to form the electron-emitting regions.

Electrodes were attached to the two samples and the voltage was applied thereto in vacuum. Then emission of electrons was recognized near the applied voltage of 50 V from the two samples respectively having the electron-emitting regions of nickel and the electron-emitting regions of porous tungsten metal.

It was verified that electric current values were stabler in the sample with the electron-emitting members of porous tungsten than in the sample with the electron-emitting members of nickel. Then the structure of the electron-emitting members of nickel and the structure of the electron-emitting members of tungsten were observed with TEM and it was found that the tungsten electron-emitting members were porous as shown in FIG. 5B but the nickel electron-emitting members were denser in structure than the tungsten electron-emitting members.

It was thus verified from the above that the electron-emitting regions of the present invention were rarely affected by microdischarge because of the porous structure and sufficient current amounts were able to be ensured on a stable basis from the numerous electron-emitting regions.

The electric current in the sample produced with the hole width enlarging process was approximately two times that in the sample produced without the hole width enlarging process. The reason is that the electric field was concentrated more.

There will be presented examples of the second structure of the present invention to describe the production method thereof and the structure of the present invention. In the description hereinafter, the anodization in the bath (oxalic acid, phosphoric acid, sulfuric acid, etc.) for the formation of the porous film will be called first anodization, and the anodization in the bath (ammonium borate, ammonium tartrate, ammonium citrate, etc.) for the formation of the barrier film, second anodization.

Example 6

The present example concerns the conditions under which the second structure of the present invention can be formed.

A Ti film and a W film were deposited in the thickness of 5 nm and in the thickness of 50 nm, respectively, on a glass substrate by RF sputtering and thereafter an element of Nb, Mo, Ta, Ti, Zr, or Hf was deposited as an upper underlying electrode in the thickness of 2 nm on each substrate, thus preparing six types of substrates, four per type of substrate (24 substrates in total). Further, an Al film was deposited in the thickness of 500 nm on each of the substrates.

Figure 8:
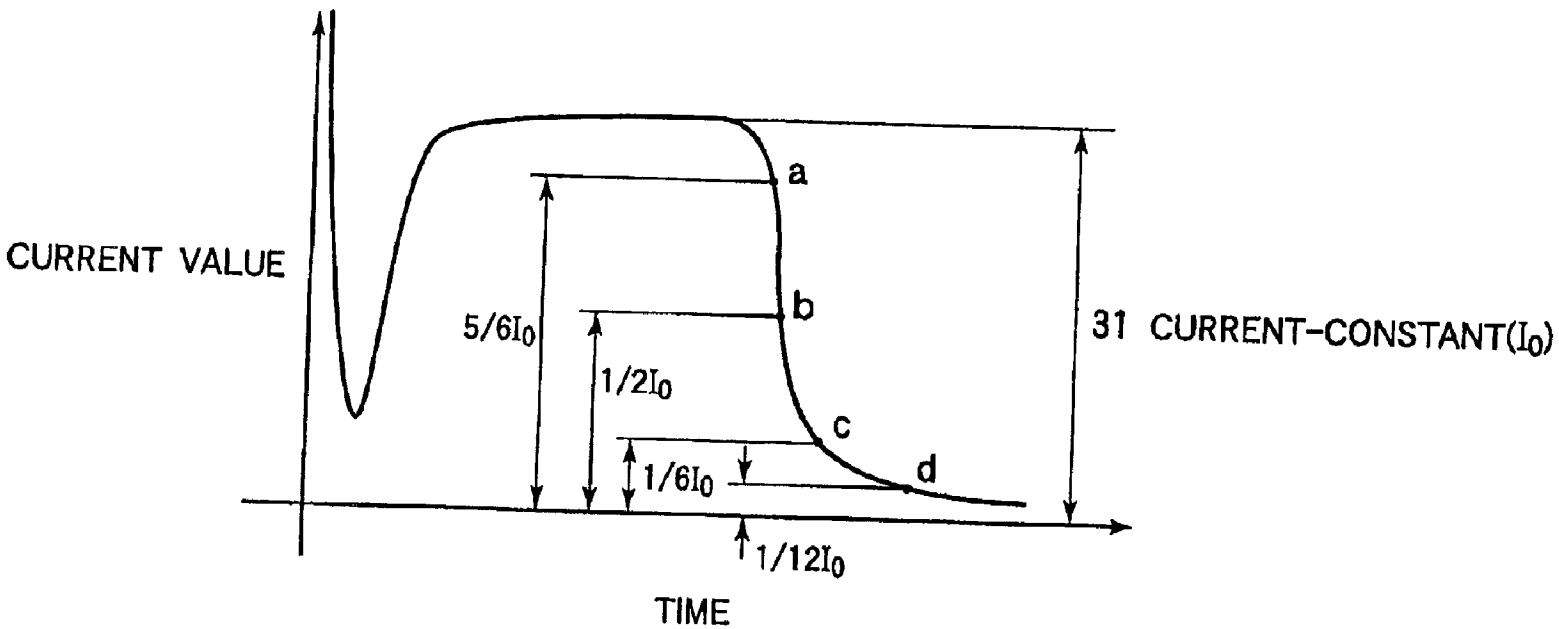
FIG. 8 is a profile of electric current for the first anodization in the sixth example of the structure according to the present invention.

FIG. 8 shows the end conditions a, b, c, and d in the first anodization in 0.3 mol/l aqueous solution of oxalic acid for the above samples (substrates). FIG. 8 is the profile of electric current during the first anodization in the present example.

The conditions a, b, c, and d shown in FIG. 8, correspond to respective cases in which the electric current is reduced to $(5/6)I_0$, $(1/2)I_0$, $(1/6)I_0$, and $(1/12)I_0$, respectively, in order from the constant current value $I_0$.

Further, these samples were subjected to the second anodization in 0.05 mol/l aqueous solution of ammonium borate at the applied voltage of 160 V and the results of visual observation thereof are presented in the table shown in FIG. 9. FIG. 9 is the table showing the results of visual observation of the samples after the second anodization was carried out in the 0.05 mol/l aqueous solution of ammonium borate at the applied voltage of 160 V in the present example. The comparative example herein was a sample with only the W layer.

It was verified from the above results that the stability in the anodization was able to be enhanced by provision of the new layer on the W layer. The reason for the destruction during the anodization is conceivably bubbles generated by the high voltage and it is speculated from this point that the new layer is also advantageous for enhancement of adhesion with the anodized alumina nano-holes.

Example 7

The present example concerns the enclosed substances in the second embodiment of the present invention. Five types of substrates were prepared in such a way that a Ti layer and a W layer were deposited in the thickness of 5 nm and in the thickness of 50 nm, respectively, on each glass substrate by RF sputtering and thereafter an Nb layer was deposited as an upper underlying electrode in the thickness of 1 nm, 5 nm, 10 nm, or 20 nm for each of four substrates but was not deposited for the other substrate. After that, an Al film was deposited in the thickness of 500 nm on each of the substrates.

Each of the substrates was subjected to the first anodization in 0.3 mol/l aqueous solution of oxalic acid and the first anodization was terminated when the current value $I_0$ was reduced to $(1/3)I_0$. Then the second anodization was carried out in 0.05 mol/l aqueous solution of ammonium borate at the voltage of 160 V, thereby forming the enclosed substances. The height of the enclosed substances was observed by FE-SEM (Field Emission-Scanning Electron Microscopy) and the results thereof are presented in the table shown in FIG. 10. FIG. 10 is the table showing the observation results of the height of the enclosed substances in the samples in which the enclosed substances were formed by carrying out the second anodization in the 0.05 mol/l aqueous solution of ammonium borate at the voltage of 160 V in the present example.

As apparent from the table shown in FIG. 10, the height of the enclosed substances increases with increase in the thickness of the Nb film.

Then these samples were annealed at 400° C. in a reducing atmosphere for the purpose of enhancing the electric conductivity, and presence/absence of electron emission was checked under provision of the deriving electrode of Ta. The condition was expressed by a ratio of electron emission to that of the sample without the Nb layer. FIG. 11 shows a table of the results. FIG. 11 is the table showing the measurement results of electron emission ratio in the present example.

The reason why the electron emission ratio decreased in the presence of the Nb film, as shown in FIG. 11, is conceivably that the oxide produced by the anodization of Nb was not reduced well by the reduction treatment by the heat at 400° C.

It was found from the above that the structure was able to be constructed stably and the electron emission was good in the range where the thickness of the Nb film was 1 to 5 nm.

Example 8

The present example concerns the underlying electrode in the second structure of the present invention. A Ti layer 5 nm thick and a W layer 50 nm thick were deposited on a glass substrate by RF sputtering and thereafter an Nb layer 2.5 nm thick was deposited as an upper underlying electrode. Then an Al film was deposited in the thickness of 500 nm thereon.

This was subjected to the first anodization in 0.3 mol/l aqueous solution of oxalic acid at the applied voltage of 40 V. In the subsequent step the second anodization was carried out in 0.05 mol/l aqueous solution of ammonium borate. The second anodization was carried out at the applied voltage of 100 V, 150 V, or 200 V, and thereafter the upper underlying electrode was observed by FE-SEM.

Figure 12A:
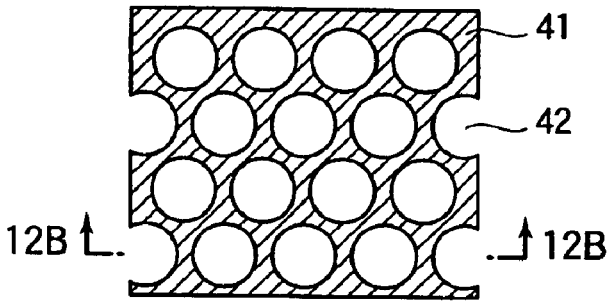
FIGS. 12A, 12B, 12C, and 12D are schematic diagrams concerning the shape of an upper underlying electrode layer after production of the structure in the eighth example of the structure according to the present invention.
Figure 12B:
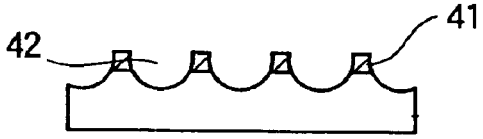
Figure 12C:
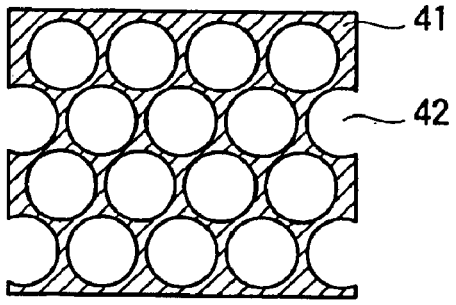
Figure 12D:
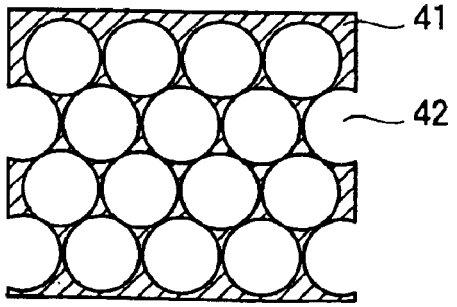
Figure 13A:
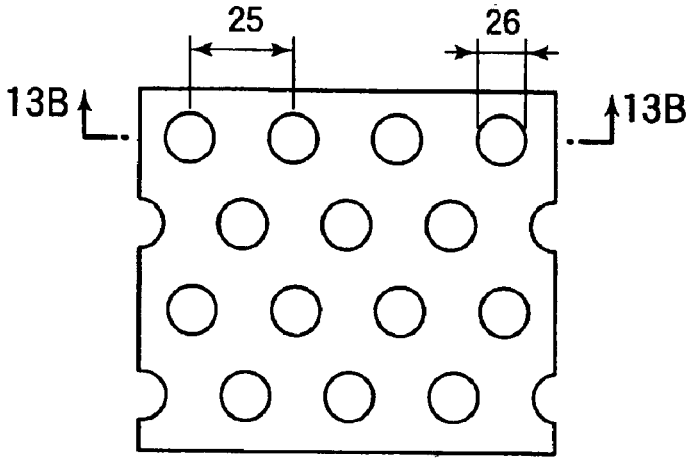
FIGS. 13A, 13B, and 13C are schematic views of films obtained by the anodization of aluminum.
Figure 13B:
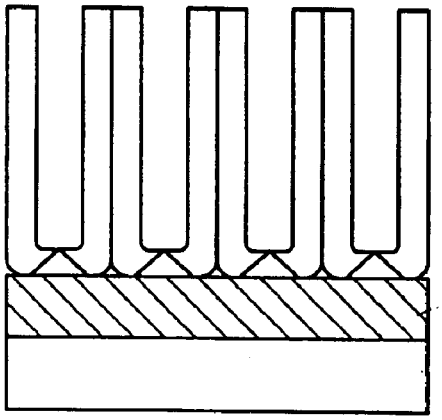
Figure 13C:
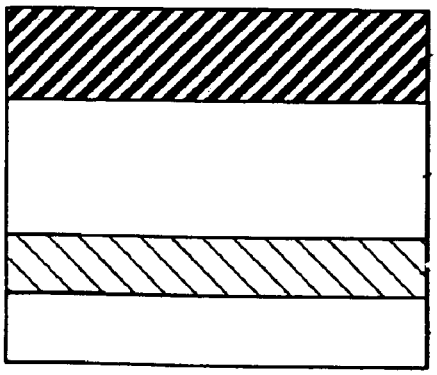

It was found from the observation that the upper underlying electrode was formed as shown in FIG. 12A with application of 100 V, as shown in FIG. 12C with application of 150 V, or as shown in FIG. 12D with application of 200 V. FIG. 12B shows a cross-sectional shape along line 12B—12B of FIG. 12A. FIGS. 12A to 12D are schematic diagrams concerning the shape of the upper underlying electrode layer after the production of the structure in the present example.

It was confirmed from the above that, though varying its shape in the production steps, the upper underlying electrode layer existed finally in the forms as shown in FIGS. 12A–12D and coupled the pores formed by the anodization, to the substrate.

As described above, the present invention provides the following effects.

When the electron-emitting device is constructed using the structure having the porous enclosed substances consisting of the electric conductor the main component of which is W, Nb, Mo, Ta, Ti, Zr, Hf, or an oxide of either element according to the present invention, the electron-emitting device is sufficiently resistant to the microdischarge and ensures stable emission current.

When the pores are regularly arrayed by use of FIB (Focused Ion Beam), the straight enclosed substances are formed normally to the substrate, thus considerably enhancing the uniformity. This makes it feasible to apply the electric field uniformly as compared with the conventional electron-emitting devices and to stabilize the electric current values resulting from the electron emission.

Further, the production method of the structure according to the present invention made it feasible to form the enclosed substances becoming the electron emission regions of uniform height readily and in a large area.

Since the second structure of the present invention is characterized in that the oxide produced in the anodization of the layer in contact with the bottom portion of the pores is insoluble or hard to solve in alkali or acid, it becomes feasible to prevent weakening of adhesion between the underlying electrode and pores due to oxidation and erosion of the underlying electrode by repetition of the anodization steps, thereby preventing occurrence of structural destruction.

It also became feasible to select the sufficiently gentle production conditions for production of samples.

In particular, this effect was most prominent when Nb, Mo, Ta, Ti, Zr, or Hf was contained as a component in the layer in contact with the bottom portion of the anodized alumina nano-holes in the underlying electrode and W was contained as a component in the lower underlying electrode adjacent thereto.

What is claimed is:

1. A structure comprising:

an electroconductive film;

a layer placed on the electroconductive film and comprising aluminum oxide as a main component;

at least one pore placed in said layer comprising aluminum oxide as a main component; and an electric conductor placed in said at least one pore and comprising a material of said electroconductive film, wherein said electric conductor is porous and is electrically connected to said electroconductive film.

2. The structure according to claim 1, wherein said electroconductive film contains an element except for aluminum as a main component.

3. The structure according to claim 1 or 2, wherein each electric conductor is cylindrical.

4. The structure according to claim 1, wherein said at least one pore has a porous wall, and an electrode capable of setting electron emission from said electric conductor is provided at an upper portion of the porous wall.

5. An electron-emitting device comprising:

an electroconductive film;

a layer placed on the electroconductive film and comprising aluminum oxide as a main component;

at least one pore placed in said layer comprising aluminum oxide as a main component; and an electron emitter placed in said at least one pore and comprising a material of said electroconductive film, wherein said electron emitter is porous and is electrically connected to said electroconductive film.

6. The electron-emitting device according to claim 5, wherein said electroconductive film contains an element except for aluminum as a main component.

7. The electron-emitting device according to claim 5, wherein each electron emitter is cylindrical.

8. The electron-emitting device according to claim 5, further comprising a deriving electrode provided at an upper end of each said at least one pore placed in said layer comprising aluminum oxide as a main component, wherein a bias is applied thereto to enable emission of electrons from the electron emitter corresponding to the deriving electrode.

9. An image-forming apparatus comprising an electron-emitting device and a member which forms an image when irradiated with electrons emitted from the electron-emitting device, wherein said electron-emitting device is the electron-emitting device as set forth in any one of claims 5 to 8.

10. The electron-emitting device according to claim 5, wherein said at least one pore has a porous wall, and an electrode capable of setting electron emission from said electron emitter is provided at an upper portion of the porous wall.

11. A structure comprising:

an underlying electrode;

at least one pore formed by anodization of a film laid on said underlying electrode and comprising aluminum as a main component; and an enclosed substance placed in said at least one pore and formed from a bottom portion of said at least one pore, wherein said enclosed substance comprises a constitutive element of the underlying electrode or an oxide thereof as a main component and is porous.

12. The structure according to claim 11, wherein said underlying electrode contains an element except for aluminum as a main component.

13. The structure according to claim 11, wherein said enclosed substance is electrically conductive.

14. The structure according to claim 11, wherein a packing factor of said enclosed substance is not more than 80%.

15. The structure according to claim 11, wherein a metal containing at least one element out of W, Nb, Mo, Ta, Ti, Zr, and Hf as a main component is included in said underlying electrode.

16. The structure according to claim 11, wherein said at least one pore includes pores arrayed uniformly.

17. The structure according to claim 11, wherein said enclosed substance fills from a bottom part of said at least one pore to a midpoint of said at least one pore and a size of said at least one pore in a portion thereof that does not include said enclosed substance is larger than a size of another portion of said at least one pore including said enclosed substance.

18. The structure according to any one of claims 11 to 17, further comprising a deriving electrode provided at an upper end of said at least one pore, wherein a bias is applied thereto to enable emission of electrons from said enclosed substance.

19. The structure according to claim 11, wherein said at least one pore has a porous wall, and an electrode capable of setting electron emission from said enclosed substance is provided at an upper portion of the porous wall.

20. A structure comprising:

an electroconductive film;

a layer placed on the electroconductive film and comprising aluminum oxide as a component;

at least one pore placed in the layer comprising aluminum oxide as a component; and a porous electric conductor placed in said at least one pore, electrically connected to the electroconductive film, and comprising a material of said electroconductive film, wherein said electroconductive film consists of two or more layers of films and at least one element out of elements included in every film is different from at least one element out of elements included in other ones of the films.

21. The structure according to claim 20, wherein said electroconductive film is characterized in that an oxide formed by anodization of a layer in contact with said layer comprising aluminum oxide as a component is insoluble or hard to solve in alkali or acid.

22. The structure according to claim 20 or 21, wherein said electroconductive film is characterized in that a layer in contact with said layer comprising aluminum oxide as a component contains at least one selected from Nb, Mo, Ta, Ti, Zr, and Hf as a component and a layer adjacent thereto contains at least W as a component.

23. The structure according to claim 20, wherein said at least one pore has a porous wall, and an electrode capable of setting electron emission from said porous electric conductor is provided at an upper portion of the porous wall.

24. An electron-emitting device comprising:

an electroconductive film;

a layer placed on the electroconductive film and comprising aluminum oxide as a component;

at least one pore placed in the layer comprising aluminum oxide as a component; and a porous electron emitter placed in said at least one pore, electrically connected to the electroconductive film, and comprising a material of said electroconductive film, wherein said electroconductive film consists of two or more layers of films and at least one element out of elements included in every film is different from at least one element out of elements included in other ones of the films.

25. The electron-emitting device according to claim 24, wherein said electroconductive film is characterized in that an oxide formed by anodization of a layer in contact with said layer comprising aluminum oxide as a component is insoluble or hard to solve in alkali or acid.

26. The electron-emitting device according to claim 24, wherein said electroconductive film is characterized in that a layer in contact with said layer comprising aluminum oxide as a component contains at least one selected from Nb, Mo, Ta, Ti, Zr, and Hf as a component and a layer adjacent thereto contains at least W as a component.

27. The electron-emitting device according to any one of claims 24 to 26, further comprising a deriving electrode provided at an upper end of said at least one pore placed in said layer comprising aluminum oxide as a component, wherein a bias is applied to said deriving electrode to enable emission of electrons from the electron emitter corresponding to the deriving electrode.

28. An image-forming apparatus comprising the electron-emitting device as set forth in claim 27, and a member which forms an image when irradiated with electrons emitted from the electron-emitting device.

29. The electron-emitting device according to claim 24, wherein said at least one pore has a porous wall, and an electrode capable of setting electron emission from said porous electron emitter is provided at an upper portion of the porous wall.

30. A structure comprising:

an underlying electrode;

at least one pore formed by anodization of a film laid on said underlying electrode and comprising aluminum as a component; and a porous enclosed substance placed inside said at least one pore, formed from a bottom portion of said at least one pore, and comprising a constitutive element of said underlying electrode or an oxide thereof as a component, wherein said underlying electrode consists of two or more layers of films and at least one element out of elements included in every film is different from at least one element out of elements included in other ones of the films.

31. The structure according to claim 30, wherein in the underlying electrode, an oxide formed by anodization of a layer in contact with the bottom portion of said at least one pore is insoluble or hard to solve in alkali or acid.

32. The structure according to claim 30 or 31, wherein said underlying electrode in contact with the bottom portion of said at least one pore, contains at least one element selected from Nb, Mo, Ta, Ti, Zr, and Hf as a component and a layer adjacent thereto contains at least W as a component.

33. The structure according to claim 30, wherein said at least one pore has a porous wall, and an electrode capable of setting electron emission from said porous enclosed substance is provided at an upper portion of the porous wall.

* * * * *

UNITED STATES PATENT AND TRADEMARK OFFICE

CERTIFICATE OF CORRECTION

PATENT NO. : 6,943,488 B2
DATED : September 13, 2005
INVENTOR(S) : Nobuhiro Yasui et al.

It is certified that error appears in the above-identified patent and that said Letters Patent is hereby corrected as shown below:

Column 5,
Line 31, “does” should read -- is --.

Column 9,
Line 45, “pacing” should read -- packing --.

Column 13,
Line 53, “solve” should read -- dissolve --.

Column 15,
Line 45, “solve” should read -- dissolve --.

Column 16,
Lines 10 and 54, “solve” should read -- dissolve --.

Signed and Sealed this

Eighteenth Day of April, 2006

JON W. DUDAS
*Director of the United States Patent and Trademark Office*